United States Patent [19]

Dugan et al.

[11] 4,378,684

[45] Apr. 5, 1983

[54] DOUBLE CYLINDER SLIDING DOOR LOCK

[76] Inventors: Thomas J. Dugan, 226 Paseo de Cristobal; Dennis G. Dugan, 117 Avenida Dominguez, both of San Clemente, Calif. 92672

[21] Appl. No.: 178,370

[22] Filed: Aug. 15, 1980

[51] Int. Cl.[3] ..... E05B 65/08

[52] U.S. Cl. ..... 70/100; 70/137; 292/DIG. 46

[58] Field of Search ..... 292/DIG. 46, DIG. 47, 292/DIG. 20; 70/95–97, 100, 137, 139, 135

[56] References Cited

U.S. PATENT DOCUMENTS

| | | | |
|---|---|---|---|
| 1,380,116 | 5/1921 | Solaini | 70/139 X |
| 2,781,656 | 2/1957 | Guzman | 70/100 X |
| 3,531,956 | 10/1970 | D'Ettorre et al. | 70/139 X |
| 3,899,201 | 8/1975 | Paioletti | 70/100 X |

FOREIGN PATENT DOCUMENTS

| | | | |
|---|---|---|---|
| 1498849 | 1/1978 | United Kingdom | 70/95 |

OTHER PUBLICATIONS

Advertising brochure, "Door & Window Home Security Hardware" of S&D Industries, Inc., San Clemente, CA., upper portion of p. 3.

*Primary Examiner*—William E. Lyddane
*Attorney, Agent, or Firm*—Boniard I. Brown

[57] ABSTRACT

A locking mechanism for a door which includes a locking member for securing an associated door in a closed position, apparatus for mounting the locking member to permit rotation about an axis, a first locking cylinder extending in a first direction which operatively cooperates with the locking member, and a second locking cylinder extending in a second direction which is opposite to the first direction, the second locking cylinder operatively cooperating with the locking member.

4 Claims, 8 Drawing Figures

DOUBLE CYLINDER SLIDING DOOR LOCK

BACKGROUND OF THE INVENTION

The invention relates to apparatus for locking doors. While particularly suited for locking of sliding glass doors, it will be understood that it does also have application to other hinged doors. The prior art includes locking apparatus which uses a single lock cylinder on one side of the door and a handle on the other side of the door which each operate the locking member. Such locks permit the homeowner to exit through the doorway of the sliding door and then lock the door using a key which cooperates with a locking cylinder on the other side of the door.

With the prior art apparatus a burglar may enter the building equipped with such a door lock and then may simply unlock the sliding door by turning the handle on the interior side thereof and pass out of the building with bulky objects such as television sets, stereos and the like. This problem is most acute with sliding doors which typically open onto a patio, not only because of the larger glass door permits the passage of large objects, but also because the door is typically located on the rear of the building where the exit by unauthorized persons will not be observed. The mode of operation to remove bulky objects is used commonly enough to justify apparatus which will prevent a burglar from exiting from a sliding door after he has once gained admittance to the building through some other entrance way.

Accordingly it is an object of the invention to provide apparatus which will more positively prevent exit through the doorway of a sliding door by unauthorized persons.

Still another object of the invention is to provide apparatus which is relatively strong and relatively invulnerable to being broken as by a hammer blow.

It is still another object of the invention to provide apparatus which will also function as a handle.

Still another object of the invention is to provide such a handle which will be contoured in a manner which will facilitate the operation of the door even when the user's hands are full.

SUMMARY OF THE INVENTION

The foregoing objects and other objects and advantages which shall become apparent from the detailed description of the preferred embodiment are attained in a locking mechanism for a sliding door which includes a locking member for securing an associated sliding door in a closed position and means for mounting the locking member to permit rotation about an axis. The apparatus also includes a first locking cylinder extending in a first direction which operatively cooperates with the locking member and a second locking cylinder extending in a second direction which is opposite to the first direction. The second locking cylinder also operatively cooperates with the locking member.

The apparatus may further include means for transferring movement of one of the locking cylinders to the locking member. The locking member may be arcuate. The means for transferring may transfer rotary motion. The means for transferring motion may comprise a shaft extending intermediate the first and second locking cylinders and further includes at least a first collar cooperating with the shaft in a manner which prevents relative angular motion between the collar and the shaft.

The apparatus may further include a second collar cooperating with the shaft, the second collar including means cooperating with the shaft to prevent relative angular motion therebetween. The apparatus may include at least one spring biased member disposed with at least one generally planar surface in generally radial relationship to the axis, the spring biased member bearing on the peripheral surface of the collars during at least some angular positions thereof. The apparatus may further include means for mounting. The first locking cylinder may have a generally vertical orientation when mounted on an associated door to permit use thereof as a handle.

The invention also includes an elongated strike having an upstanding axial midsection having elongated slots for cooperation with an arcuate locking member. Elongated mounting holes are provided for adjustably mounting the strike.

BRIEF DESCRIPTION OF THE ACCOMPANYING DRAWING

DESCRIPTION OF THE PREFERRED EMBODIMENT

Figure 1:
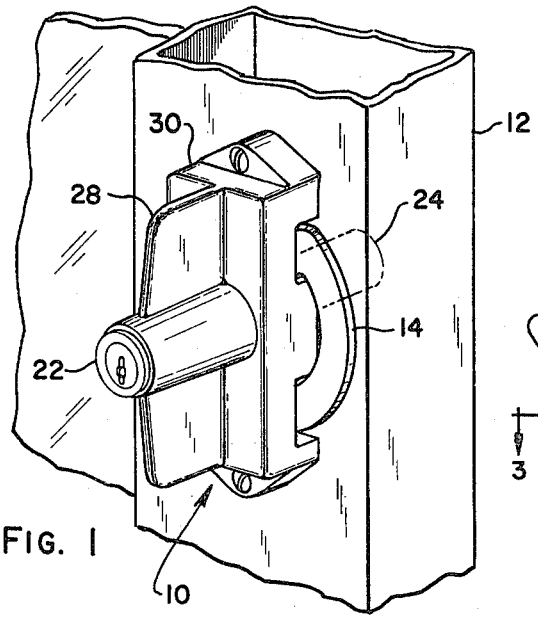
FIG. 1 is a broken away perspective view of the apparatus in accordance with the invention.
Figure 2:
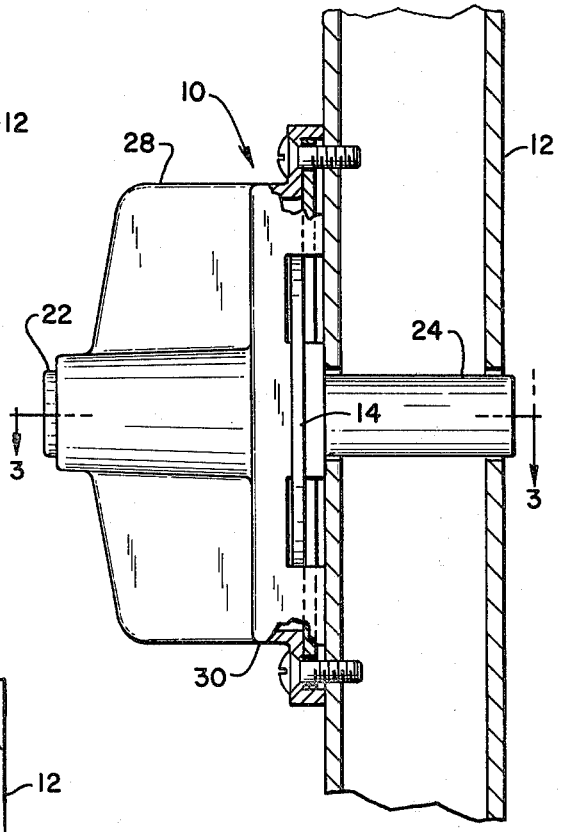
FIG. 2 is a broken away elevational view in partial section of the apparatus illustrated in FIG. 1.
Figure 3:
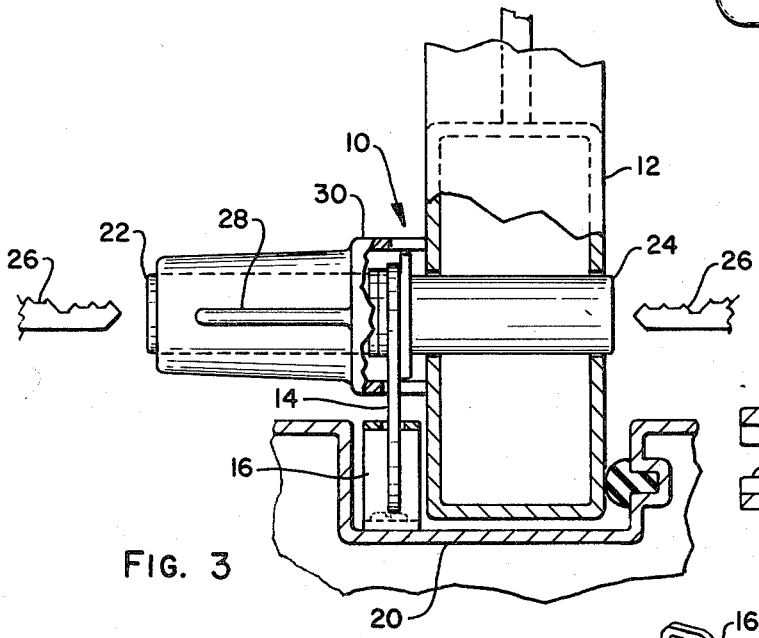
FIG. 3 is a sectional view taken along the lines 3—3 of FIG. 2.
Figure 6:
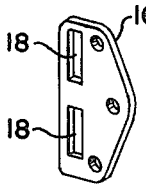
FIG. 6 is a perspective view of the stationary member which is mounted in the doorway and which cooperates with the locking mechanisms in accordance with the invention.

Referring now to FIGS. 1, 2, 3 and 4 there is shown a double cylinder lock mechanism 10 which is mounted on and in a door 12. The door 12 ordinarily will be a sliding door. The locking mechanism ordinarily will include an arcuate locking member 14 which is generally planar and which is rotated about an axis which is normal to the general plane of that member and has its center substantially at the center of curvature of the arcuate surfaces thereof. The locking member 14, in operation, passes through slots 18, 18 in the stationary member 16 which is mounted on the door jamb 20. The features of the stationary member 16 are best illustrated in FIGS. 3 and 6.

The apparatus in accordance with the invention further includes a first lock cylinder assembly 22 and a second lock cylinder assembly 24. Each of the lock cylinder assemblies 22 and 24 is of conventional design and includes conventional structure which has not been illustrated. The conventional structure includes a rotatably mounted plug or cylinder which cooperates with a plurality of radially extending pin tumblers of different lengths which are spring biased towards the axis of the rotatably mounted plug or cylinder. When a key, such as 26, is inserted into the rotatably mounted plug or cylinder the contours of the key cooperate with the pin tumblers to position each of the tumblers so that the interface between the key and the tumblers occurs essentially at the interface between the rotatably mounted plug or cylinder and the outer housing of the lock assembly. In this position the rotatably mounted plug or cylinder may be rotated freely.

It will be seen that the lock cylinder assembly 24 is mounted so that it extends through the door 12 and the lock cylinder assembly 22 is essentially surface mounted with a generally planar flange 28 extending from two sides thereof. The flange 28 serves the dual purpose of providing a handle for convenient operation of the sliding door 12 and also for securely mounting the locking cylinder assembly 22. The flange 28 will be part of a die cast housing 30 which cooperates with a generally planar member 32 which is fixed to the lock cylinder assembly 24.

Figure 5:
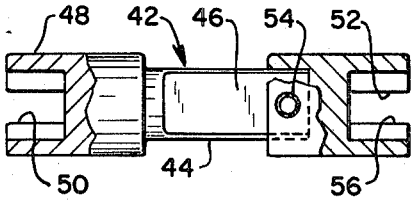
FIG. 5 is an elevational view illustrating in greater detail the central shaft of the apparatus of FIG. 1.

As best seen in FIG. 5, spade shaped member 34 is mounted intermediate a first pair of bosses 36 in the housing 30 as well as intermediate a second pair of bosses 38 which are also in the housing 30. A spring 40 urges the spade shaped member 34 in direction which is generally upward (as viewed).

Figure 4:
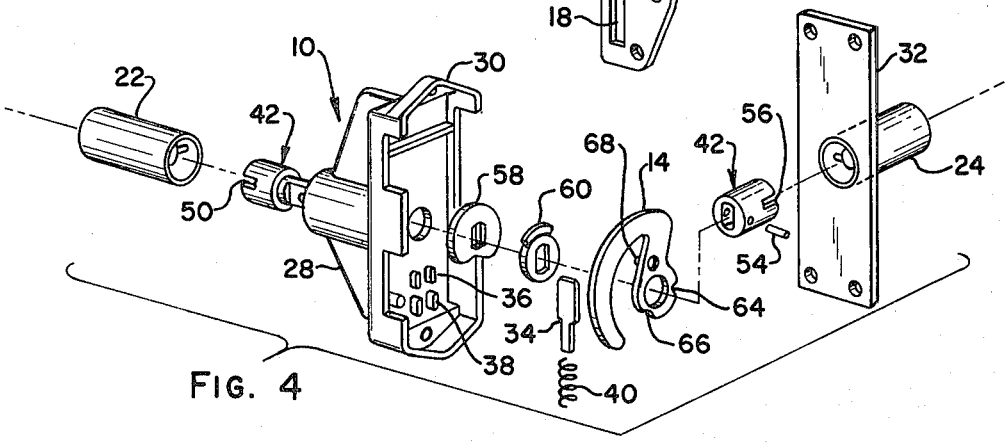
FIG. 4 is a perspective view of the apparatus in FIG. 1 in exploded relationship.

A central shaft assembly 42 includes a shaft 44 having generally planar oppositely disposed flat sides 46 (best seen in FIGS. 4 and 5). A generally cylindrical member 48 having a slot 50 extending therethrough is disposed at the left of the extremity of the shaft 42. Ordinarily the generally cylindrical axial extremity 48 will be fixed to the shaft 44. At the right axial extremity (as viewed) a second generally cylindrical member 52 is connected to shaft 44 by means of a pin 54. The generally cylindrical member 52 is provided with a slot 56. It will be understood that the general contours of the generally cylindrical members 48, 52 are generally similar.

Carried on the the shaft 44 and particularly on an axial portion thereof which includes the opposed flat sides 46 are a first collar 58, a second collar 60 and a locking member 14. It will be seen that the first and second collars 58, 60 are each provided with a central rectangular shaped opening which is dimensioned and configured for engagement with the flat surfaces of shaft 44. In other words, rotation of the shaft 44 causes the collars 58, 60 to rotate therewith. In contrast, the aperture in the locking member 14 which cooperates with the shaft 44 is round so that the angular position of the locking member 14 is not determined merely by the angular position of the shaft 44.

The collar 58 functions primarily as a camming member to urge the spade shaped member 34 downward at all times except when the single recess thereof is aligned with the spade shaped member 34. The collar 60 acts primarily as a stop member to limit the angular travel of the shaft 44. The locking member 14 is provided with detents or recesses 64, 66 which are disposed at angularly spaced intervals. The locking member 14 is also provided with a protuberance 68, disposed on one side thereof, which cooperates with the collar 60.

In operation, a key 26 is inserted into either lock cylinder assembly 22, 24 causing the pin tumblers (not shown) to align themselves in a manner which allows the plug or cylinder to rotate. The geometry of the structure is such that unless a key is inserted into the key slot of the cylinder assembly 22 no rotational movement is transferred from the cylinder assembly 22 to the generally cylindrical member 48. Similarly, if no key 26 is inserted into the cylinder of the cylinder assembly 24 no rotational movement is transferred to the slot 56 of the cylindrical member 52. More specifically, the insertion of the key 26 into the key slot of either cylinder assembly 22, 24 causes it to extend into the adjacent slot 50 or 56 of the generally cylindrical members 48 or 52. Positioning of the key 26 in either keyhole followed by rotation of the key 26 thus results in transfer of rotational movement from the cylinder assembly 22 to the shaft assembly 42.

Rotational movement of the shaft assembly 42 results in rotation of the collars 58, 60. Rotation of the collar 58 from any angular position other than that shown in FIG. 5 results in the spade shaped member 34 being depressed so that it clears both recess 64 and 66 in locking member 14.

It will be best be seen that as the shaft assembly 42 is rotated the portions of the collar 60 having maximum diameter engage the protuberance 68 of the locking member 14 and, as stated above, the collar or camming member 58 serves to bias the spade shaped member 34 out of engagement with the detent surfaces or recesses 66, 64 of the locking member 14. Accordingly it will be seen that either lock cylinder assembly 22, 24 may be utilized to rotate the locking member 14 into or out of engagement with the stationary member 16 and accordingly lock or unlock the door 12.

Figure 7:
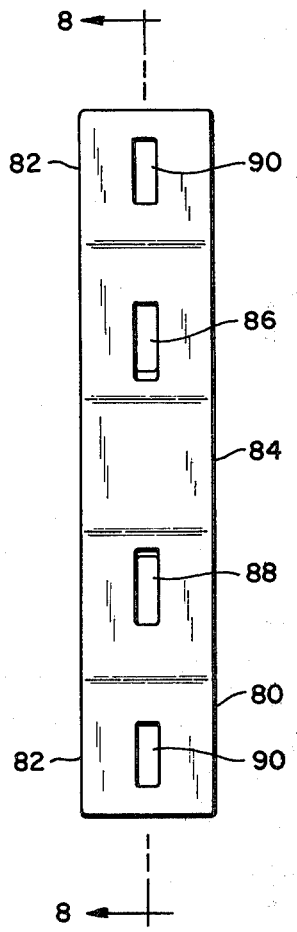
FIG. 7 is an elevational view of an improved strike in accordance with the invention.
Figure 8:
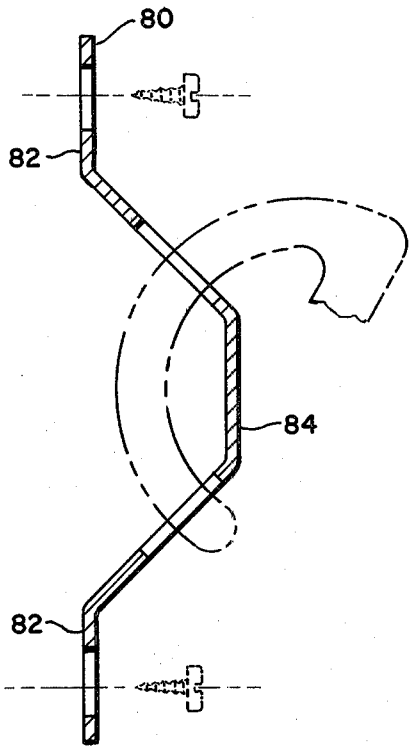
FIG. 8 is a side view of the strike illustrated in FIG. 7.

Referring now to FIGS. 7 and 8 there is shown an elongated strike 80 having axially spaced generally planar feet 82, 82 (disposed in generally coplanar relationship) and an upstanding midsection 84 having slots 86, 88 which are axially elongated. The strike is intended for cooperation with an arcuate locking member 14. It will be understood that the strike 80 may be used with either sliding doors or hinge mounted doors (not shown). The feet 82 will ordinarily have holes 90 which are elongated for maximum adjustability.

The invention has been described with reference to its illustrated preferred embodiment. Persons skilled in the art of constructing door locks may, upon exposure to the teachings herein, conceive variations in the mechanical development of the components therein. The invention, while having particular application to sliding glass doors, will be understood to also have application to hinged doors. The manner of mounting the cylinder will vary for the particular application. Other locking mechanisms including fixed cam and lazy cam locks may be used. Such variations are deemed to be encompassed by the disclosure, the invention being delimited only by the appended claims.

The inventors claim:

1. A locking mechanism for a door which comprises:

a locking member for securing an associated door in a closed position, said locking member being arcuate;

means for mounting said locking member to permit rotation about an axis;

a first lock extending in a first direction, said first lock operatively cooperating with said locking member;

a second lock extending in a second direction which is opposite to said first direction, said second lock operatively cooperating with said locking member;

means for transferring rotary movement of one of said locks to said locking member;

said means for transferring motion comprising a shaft extending intermediate said first and second lock, and further including at least a collar cooperating with said shaft in a manner which prevents relative angular motion between said collar and said shaft, a second collar cooperating with said shaft, said second collar including means cooperating with said shaft to prevent relative angular motion therebetween; and at least one spring biased member having an axis and at least one planar surface extending radially of the axis and bearing on the peripheral surfaces of the collars in at least some angular positions of the collars.

2. The apparatus as described in claim 1, further including:

means for mounting said first lock which includes a generally vertically extending body when mounted on an associated door to permit use of said vertically extending body as a handle.

3. The apparatus as described in claim 2, and further including:

an elongated strike having axially spaced generally coplanar feet, and an upstanding midsection spaced from the plane of said coplanar feet transversely of the axial direction, said strike defining first and second elongated slots extending axially of the strike.

4. The apparatus as described in claim 3, wherein:

said feet include mounting holes and at least one of said mounting holes is elongated to permit positional adjustment of said strike.

* * * * *